US005122257A

United States Patent [19]

Van Helden et al.

[11] Patent Number: 5,122,257

[45] Date of Patent: Jun. 16, 1992

[54] PROCESS FOR THE MANUFACTURE OF KEROSENE AND/OR GAS OILS

[75] Inventors: Henricus J. A. Van Helden; Niels Fabricius; Henricus M. J. Bijwaard, all of The Hague, Netherlands

[73] Assignee: Shell Internationale Research Maatschappij B.V., The Hague, Netherlands

[21] Appl. No.: 671,136

[22] Filed: Mar. 18, 1991

Related U.S. Application Data

[63] Continuation of Ser. No. 538,682, Jun. 15, 1990, abandoned, which is a continuation of Ser. No. 123,512, Nov. 20, 1987, abandoned.

[30] Foreign Application Priority Data

Dec. 10, 1986 [GB] United Kingdom ..... 8629476

[51] Int. Cl.[5] ..... C10G 51/02

[52] U.S. Cl. ..... 208;49; 208/58; 208/61; 208/78; 208/97; 208/99

[58] Field of Search ..... 208/18, 19, 49, 58, 208/61, 78, 97, 99

[56] References Cited

U.S. PATENT DOCUMENTS

| | | | |
|---|---|---|---|
| 3,642,610 | 2/1972 | Divijak, Jr. et al. | 208/58 |
| 3,876,522 | 4/1975 | Campbell et al. | 208/58 |
| 3,907,667 | 9/1975 | Murphy, Jr. et al. | 208/210 |
| 4,062,758 | 12/1977 | Goudriaan et al. | 208/80 |
| 4,238,316 | 12/1980 | Mooi et al. | 208/58 |
| 4,347,121 | 8/1982 | Mayer et al. | 208/58 |
| 4,414,097 | 11/1983 | Chester et al. | 208/59 |
| 4,437,975 | 3/1984 | Gillespie et al. | 208/87 |

*Primary Examiner*—Olik Chaudhuri
*Assistant Examiner*—G. Fourson
*Attorney, Agent, or Firm*—Jones, Tullar & Cooper

[57] ABSTRACT

Process for the manufacture of lubricating base oils wherein a hydrocarbon feedstock is catalytically treated in the presence of hydrogen at elevated temperature and pressure and wherein at least part of a heavy fraction of the material obtained is subjected to dewaxing, in which process a hydrocarbon feedstock is used containing flashed distillate produced via a residue conversion process.

38 Claims, 2 Drawing Sheets

PROCESS FOR THE MANUFACTURE OF KEROSENE AND/OR GAS OILS

Figure 1:
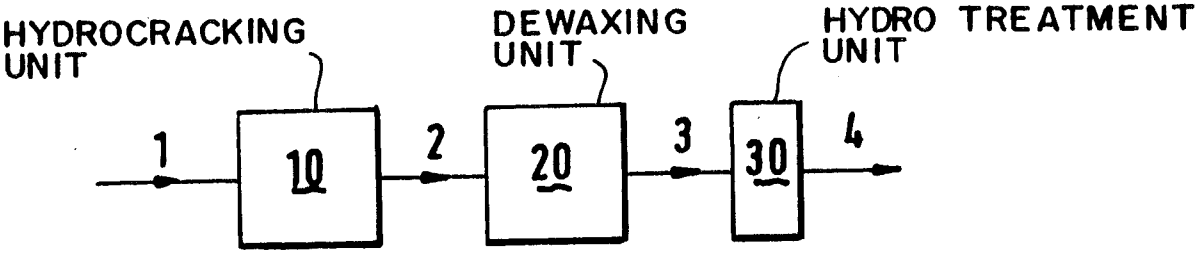

This is a continuation of co-pending application Ser. No. 07/538,682 filed on Jun. 15, 1990, which is a continuation of application Ser. No. 07/123,512, filed Nov. 20, 1987, both now abandoned.

CROSS REFERENCE TO RELATED APPLICATION

This application is related to application, Ser. No. 123,513 filed on Nov. 20, 1987.

The present invention relates to an improved process for the manufacture of lubricating base oils and to lubricating base oils thus prepared. The present invention further relates to an improved process for the manufacture of kerosene and/or gas oils together with lubricating base oils and to kerosene and/or gas oils coproduced with lubricating base oils.

Lubricating base oils are normally prepared from suitable petroleum feedstocks, in particular from (vacuum) distillates or deasphalted vacuum residues or mixtures thereof. Many approaches have evolved over the years to achieve production of high quality base oils using well-known conditions and well-known techniques including physical and/or catalytic treatments to improve product quality.

In the conventional approach to manufacturing lubricating base oils from petroleum feedstocks, fractions obtained from a crude oil and boiling in the desired lubricating base oil range (each range having a separate viscosity range) are separately treated with a suitable solvent to remove primarily undesired aromatic compounds present in the fractions and affecting the properties thereof. Such solvent extraction processes produce lubricating oil raffinates and aromatic extracts.

A non-conventional approach to the manufacture of lubricating base oils comprises the catalytic hydrotreatment of suitable feedstocks. Such catalytic hydrogenation is normally carried out at rather severe conditions e.g. at temperatures up to 500° C. and pressures up to 230 bar in the presence of suitable catalysts based on metals such as molybdenum, tungsten, nickel and cobalt to mention a few. Catalytic hydrotreatment allows production of lubricating base oils having a higher viscosity index. Also the amount of sulphur and nitrogen present in the feedstocks will be reduced substantially, typically for more than 90%.

Normally, for paraffinic crudes as lube oil feedstock, a dewaxing treatment is carried out after the solvent extraction process or the hydrogenation process to reduce the pour point of the resulting lubricating base oil. Both solvent and catalytic dewaxing can be applied. In the past acid treatments and/or clay treatments have been used to improve the resistance to oxidation of the product and to further improve the colour and colour stability of the final product. Also a rather mild hydrogenation (often referred to as hydrofinishing) of raffinates can be applied in this context.

A considerable effort has been devoted in the art to further improve one or more properties of the lubricating base oils to be produced. For instance, a multi-solvent extraction-hydrogenation process is described in U.S. Pat. No. 3,256,175 and a combined solvent extraction-dewaxing-hydrofinishing process to produce improved viscosity index lubricating base oils is described in U.S. Pat. No. 3,702,817. In European patent specification 43,681 a combined catalytic dewaxing-catalytic hydrotreatment is described. Also the technique of blending different lubricating base oils which have been subjected to one or more (pre)-treatments in order to improve the oxidation stability of the resulting mixture can be used advantageously, for instance as described in British patent specification 2,024,852. An advanced process to match the solvent extraction and catalytic hydrotreatment requirements in relation with the required viscosity of the lubricating base oil to be produced is disclosed in European patent specification 178,710.

Despite the ongoing search for improvements in the upgrading of lubricating base oils, relatively little progress has been made with respect to the suitability of heavy materials, in particular of residual nature, as feedstocks for the manufacture of good quality lubricating base oils, let alone in acceptable yields. Thusfar, heavy residual material has to be used as fuel or as feedstock for the production of pitch.

It is now proposed that heavy materials originating from vacuum residues which have been subjected to a residue conversion treatment can be used as feedstocks in the manufacture of good quality lubricating base oils. A substantial increase in the yield of lubricating base oil on crude can thus be achieved.

The present invention thus relates to a process for the manufacture of lubricating base oils wherein a hydrocarbon feedstock is catalytically treated in the presence of hydrogen at elevated temperature and pressure and wherein at least part of a heavy fraction of the material obtained is subjected to dewaxing, in which process a hydrocarbon feedstock is used containing flashed distillate produced via a residue conversion process.

By using a flashed distillate derived from a converted vacuum residue in the manufacture of lubricating base oils low quality materials are transformed into high value products which intrinsically enlarges the flexibility of the refinery operation.

It is possible to use a feedstock containing besides flashed distillate derived from a converted vacuum residue also a substantial amount of a flashed distillate which has not been subjected to a conversion process, e.g. a flashed distillate normally obtained in a vacuum distillation process. It is also possible to use flashed distillate normally obtained in an atmospheric distillation process or to use mixtures containing both flashed distillate obtained in an atmospheric distillation process and flashed distillate obtained in a vacuum distillation process as part of the feed to the catalytic hydrotreatment. The amount of vacuum residue derived flashed distillate preferably ranges between 10 and 60% by volume of the total flashed distillate used as feed for the catalytic hydrotreatment.

The feedstock to be used in the process according to the present invention is based on a flashed distillate produced via a residue conversion process, i.e. the feedstock contains a distillation product having a boiling range between 320° C. and 600° C., in particular between 350° C. and 520° C. which has been obtained by subjecting part or all of the effluent from a residue conversion process to a distillation treatment, in particular a distillation treatment under reduced pressure.

The residue conversion process operative to produce flashed distillate to be used as feedstock in the manufacture of lubricating base oils comprises a thermal conversion process such as thermal cracking, a catalytic conversion process such as a hydroconversion process or a process wherein both thermal and hydrocatalytic conversions take part. Thermal cracking processes are normally carried out using vacuum residues as feedstock which are converted in the substantial absence of catalytically active materials at a temperature between 375° C. and 575° C., in particular between 400° C. and 525° C. at pressures normally not exceeding 40 bar. Normally the thermal cracking will be carried under such conditions that not more than 20% w $C_4^-$ hydrocarbons are produced and preferably less than 10% w.

Hydrocarbon conversion processes, which may be carried out in combination with one or more pretreatments to substantially reduce the amount of heavy metals, in particular nickel and vanadium, present in asphaltenes-containing vacuum residues, and/or the amount of sulphur and to a lower extent nitrogen in vacuum residues, are normally carried out in the presence of hydrogen using an appropriate supported catalyst at a temperature of from 300° C. to 500° C., in particular of from 350° C. to 450° C., a pressure of from 50 to 300 bar, in particular of from 75 to 200 bar, a space velocity of from 0.02–10 kg. $kg^{-1}$. $h^{-1}$., in particular of from 0.1–2 kg. $kg^{-1}$. $h^{-1}$ and a hydrogen/feed ratio of from 100–5000 Nl/$kg^{-1}$, in particular of from 500–2000 Nl/$kg^{-1}$.

Suitable catalysts for carrying out the hydroconversion process are those containing at least one metal chosen from the group formed by nickel and cobalt and in addition at least one metal chosen from the group formed by molybdenum and tungsten on a carrier, preferably a carrier containing a substantial amount of alumina, e.g. at least 40% w. The amounts of the appropriate metals to be used in the hydroconversion process may vary between wide ranges and are well-known to those skilled in the art.

It should be noted that asphaltenes-containing hydrocarbon residues having a nickel and vanadium content of more than 50 ppmw are preferably subjected to a demetallization treatment. Such treatment is suitably carried out in the presence of hydrogen using a catalyst containing a substantial amount of silica, e.g. at least 80% w. If desired, one or more metals or metal compounds having hydrogenating activity such as nickel and/or vanadium may be present in the demetallization catalyst. Since the catalytic demetallization and the hydroconversion process may be carried out under the same conditions, the two processes may very suitably be carried out in the same reactor containing one or more beds of demetallization catalyst on top of one or more beds of hydroconversion catalyst.

Flashed distillate obtained via a residue conversion process is subjected, preferably together with flashed distillate originating from a distillation treatment under reduced pressure of an atmospheric residue which has not been subjected to a residue conversion process, to a catalytic treatment in the presence of hydrogen. The catalytic treatment in the presence of hydrogen can be carried out under a variety of process conditions. The severity of the treatment, ranging from predominantly hydrogenation to predominantly hydrocracking will depend on the nature of the flashed distillate(s) to be processed and the type(s) of lubricating oil to be produced. Preferably, the catalytic treatment in the presence of hydrogen is carried out under such conditions as to favour hydrocracking of the flashed distillate(s).

Suitable hydrocracking process conditions to be applied comprise temperatures in the range of from 250° C. to 500° C., pressures up to 300 bar and space velocities between 0.1 and 10 kg feed per liter of catalyst per hour. Gas/feed ratios between 100 and 5000 Nl/kg feed can suitably be used. Preferably, the hydrocracking treatment is carried out at a temperature between 300° C. and 450° C., a pressure between 25 and 200 bar and a space velocity between 0.2 and 5 kg feed per liter of catalyst per hour. Preferably, gas/feed ratios between 250 and 2000 are applied.

Well-established amorphous hydrocracking catalysts can be suitably applied as well as zeolite-based hydrocracking catalysts which may have been adapted by techniques like ammonium ion exchange and various forms of calcination in order to improve the performance of the hydrocracking catalysts based on such zeolites.

Zeolites particularly suitable as starting materials for the manufacture of hydrocracking catalysts comprise the well-known synthetic zeolite Y and its more recent modifications such as the various forms of ultra-stable zeolite Y. Preference is given to the use of modified Y-based hydrocracking catalysts wherein the zeolite used has a pore volume which is made up to a substantial amount of pores having a diameter of at least 8 nm. The zeolitic hydrocracking catalysts may also contain other active components such as silica-alumina as well as binder materials such as alumina.

The hydrocracking catalysts contain at least one hydrogenation component of a Group VI metal and/or at least one hydrogenation component of a Group VIII metal. Suitably, the catalyst compositions comprise one or more components of nickel and/or cobalt and one or more components of molybdenum and/or tungsten or one or more components of platinum and/or palladium. The amount(s) of hydrogenation component(s) in the catalyst composition suitably range between 0.05 and 10% w of Group VIII metal component(s) and between 2 and 40% w of Group VI metal component(s), calculated as metal(s) per 100 parts by weight of total catalyst. The hydrogenation components in the catalyst compositions may be in the oxidic and/or the sulphidic form. If a combination of at least a Group VI and a Group VIII metal component is present as (mixed) oxides, it will be subjected to a sulphiding treatment prior to proper use in hydrocracking.

If desired, a single hydrocracking reactor can be used in the process according to the present invention, wherein also flashed distillate obtained via vacuum distillation of an atmospheric residue which has not been subjected to a residue conversion process can be co-processed. It is also possible to process a feedstock containing a flashed distillate produced via a residue conversion process in parallel with a feedstock containing a flashed distillate obtained via vacuum distillation of an atmospheric residue in a second hydrocracker. The hydrocrackers may be operated at the same or different process conditions and the effluents may be combined prior to further treatment.

At least part of the heavy material obtained in the hydrocatalytic treatment is subjected to a dewaxing treatment in order to produce good quality lubricating base oils. Both solvent dewaxing and catalytic dewaxing can be suitably applied. It is also possible to subject some of the hydrocatalytically treated effluent to solvent dewaxing and some, in particular higher boiling effluent to catalytic dewaxing.

Solvent dewaxing is normally carried out by using two solvents, one of which dissolves the oil and maintains fluidity at low temperature (e.g. toluene) and the other which dissolves little wax at low temperature and which acts as a wax precipitating agent (e.g. methyl ethyl ketone). Normally, the product to be dewaxed is mixed with the solvents employed and heated to insure solution. The mixture is then cooled down to filtration temperature, usually in the range of from −10° C. to −40° C. The cooled mixture is then filtered and the separated wax washed with cooled solvent. Finally, the solvents are recovered from the dewaxed oil and from the separated wax by filtration and recirculation of the solvents into the process.

It will be appreciated that preference will be given from an integrated process point of view to a catalytic dewaxing treatment in view of the huge energy costs involved in solvent dewaxing due to heating, cooling and transporting large amounts of solvents. Catalytic dewaxing is suitably carried out by contacting part or all of the effluent from the hydrocatalytic treatment in the presence of hydrogen with an appropriate catalyst. Suitable catalysts comprise crystalline aluminium silicates such as ZSM-5 and related compounds, e.g. ZSM-8, ZSM-11, ZSM-23 and ZSM-35 as well as ferrierite type compounds. Good results can also be obtained using composite crystalline aluminium silicates wherein various crystalline structures appear to be present. Normally, the catalytic dewaxing catalysts will comprise metal compounds such as Group VI and/or Group VIII compounds.

The catalytic hydrodewaxing may very suitably be carried out at a temperature of from 250° C. to 500° C., a hydrogen pressure of from 5–200 bar, a space velocity of from 0.1–5 kg per liter feed per hour and a hydrogen/feed ratio of from 100–2500 Nl/kg of feed. Preferably, the catalytic hydrodewaxing is carried out at a temperature of from 275° C. to 450° C., a hydrogen pressure of from 10–110 bar, a space velocity of from 0.2–3 kg per liter per hour and a hydrogen/feed ratio of from 200–2,000 Nl per kg of feed.

The catalytic dewaxing can be carried out in one or more catalytic dewaxing units which may operate under the same or under different conditions. When two catalytic hydrotreatment units have been used in processing different flashed distillates as discussed hereinabove, it may be advantageous to operate two catalytic hydrodewaxing units which then operate preferably under different process conditions adapted to the particular effluent (or part thereof) processed and/or the quality of the lubricating base oil(s) to be produced.

The catalytic dewaxing treatment is carried out suitably using effluent(s) from one or more hydrotreatment units having an effective cut point of at least 320° C. Preferably, part of the hydrocatalytically treated material having an effective cut point of at least 370° C. is subjected to catalytic dewaxing, the remainder is preferably recycled to the catalytic hydrotreatment unit. When the process in accordance with the present invention is carried out in parallel hydrotreatment mode it may be advantageous to subject the combined effluents from the catalytic hydrotreatment units to catalytic dewaxing.

It may be advantageous with respect to further improving product quality to subject the effluent from the catalytic hydrotreatment to a further hydrotreatment. This further hydrotreatment can be carried out prior to the dewaxing stage, in particular prior to the catalytic dewaxing stage, but may also be carried out, as is indeed preferred, after the (catalytic) dewaxing treatment has been carried out. This further hydrotreatment is suitably carried out at a temperature between 250° C. and 375° C. and a pressure between 45 and 250 bar, to primarily hydrogenate unsaturated components present in (dewaxed) material. Catalysts suitably applied in the further hydrotreatment include Group VIII metals, in particular Group VIII noble metals, on a suitable support such as silica, alumina or silica-alumina. A preferred catalyst system comprises platinum on silica-alumina.

The process according to the present invention is in particular advantageous in that it allows an integrated approach to the production of good quality lubricating oils directly from an atmospheric residue which serves not only as the source for the feedstock to be used, i.e. flashed distillate obtained via a residue conversion process using the vacuum residue as feedstock, but also as the source for any additional flashed distillate (not obtained via a residue conversion process) to be co-processed. It should also be noted that depending on the severity of the catalytic hydrotreatment employed, kerosene and/or gas oil can be coproduced from materials which have not been subjected to the (catalytic) dewaxing stage to produce lubricating oils.

The present invention will now be illustrated by means of FIGS. 1–4. In FIG. 1 a process is depicted for the production of lubricating base oils by catalytic hydrotreatment of a flashed distillate obtained via a residue conversion process and (catalytic) dewaxing of the product thus obtained.

Figure 2:
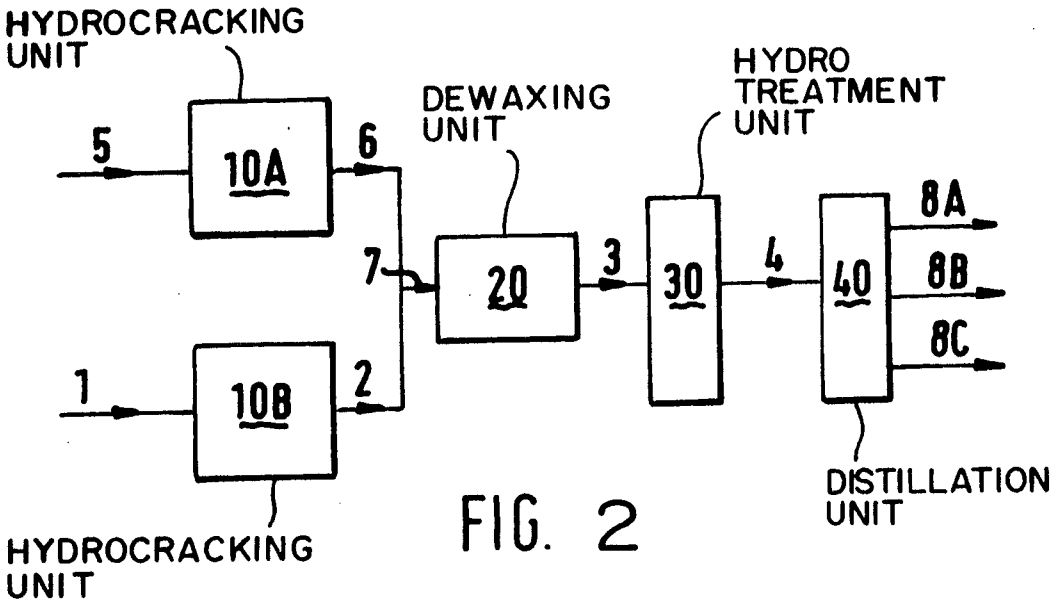

In FIG. 2 a process is depicted wherein use is made of two different catalytic hydrotreatments followed by catalytic dewaxing of the combined effluent and distillation of the dewaxed material obtained.

Figure 3:
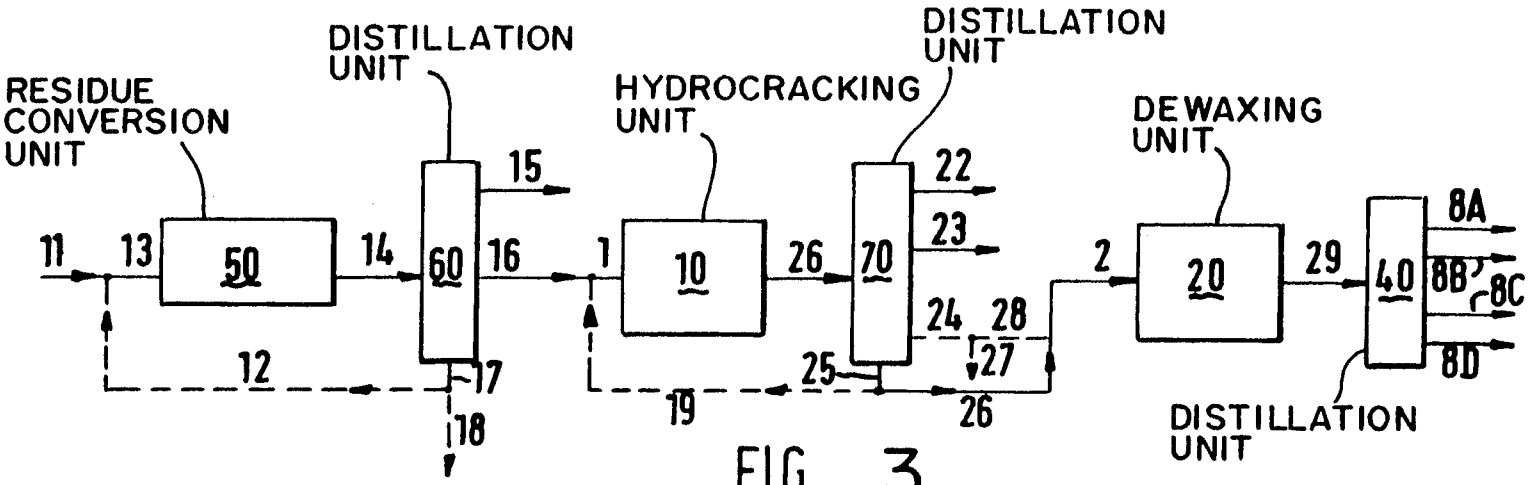

In FIG. 3 a further process embodiment is depicted for the co-production of kerosene and/or gas oil starting from a vacuum residue.

Figure 4:
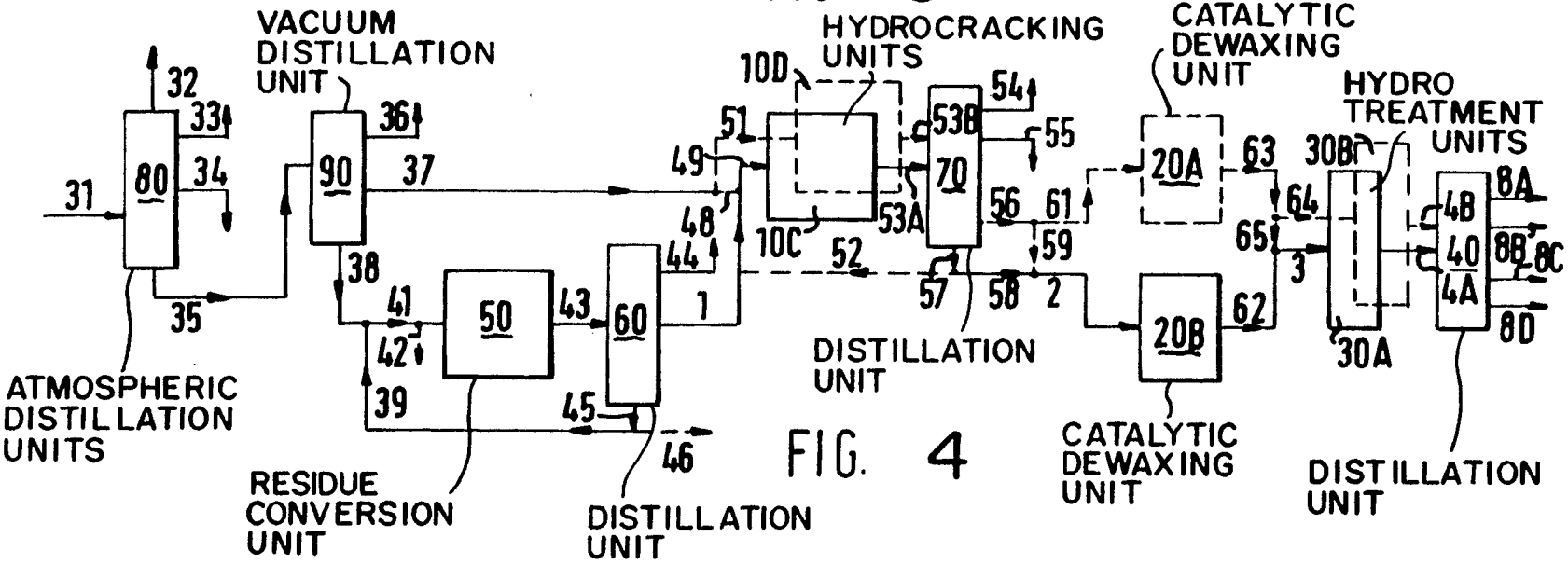

In FIG. 4 an integrated process scheme is depicted for the production of various lubricating oil fractions together with kerosene and/or gas oil starting from crude oil. In this process two catalytic hydrotreatments and two catalytic dewaxing units can be employed.

Preferably, the process according to the present invention is carried out by subjecting a crude oil to an atmospheric distillation to produce one or more atmospheric distillates suitable for the production of kerosene and/or gas oil(s) and an atmospheric residue which is subjected to distillation under reduced pressure to produce a light distillate suitable for the production of gas oil(s), a flashed distillate which may be subjected to a catalytic (cracking) treatment in the presence of hydrogen and a vacuum residue which is used at least partly as feedstock in a catalytic residue conversion process to produce one or more gas oils and a flashed distillate to be subjected to a catalytic (cracking) treatment in the presence of hydrogen whilst part or all of the bottom fraction may be recycled to the residue conversion unit and wherein catalytically treated material is subjected to a distillation treatment to obtain kerosene and one or more gas oils whilst the heavier material obtained is subjected to (catalytic) dewaxing and subsequent hydrotreating and wherein the lubricating base oil fractions produced are separated by distillation from the hydrotreated material.

It is further preferred to subject flashed distillate obtained by distillation under reduced pressure and flashed distillate obtained via a catalytic residue conversion process to a catalytic cracking treatment in the presence of hydrogen in the same reactor. It is further preferred to subject a heavy distillate fraction and (part of) the bottom fraction obtained after distillation of the cracked material to different catalytic dewaxing treatments. When separate catalytic dewaxing treatments have been carried out it is preferred to combine the catalytically dewaxed materials and subject them to hydrotreatment.

In FIG. 1 a process is depicted comprising a hydrocracking unit 10, a catalytic dewaxing unit 20 and a hydrotreatment unit 30. The hydrotreatment unit 30 is optional in the process according to the present invention. A flashed distillate produced via a residue conversion process is fed via line 1 into the hydrocracking unit 10. The effluent from the hydrocracking unit 10, which may be subjected to a treatment to remove gaseous materials is introduced via line 2 into the catalytic dewaxing unit 20. The product from the catalytic dewaxing unit 20 may serve as lubricating base oil. It may also be subjected to a hydrotreatment in unit 30 to produce a hydrotreated lubricating base oil via line 4.

In FIG. 2 a process is depicted comprising two hydrocracking units 10A and 10B, a catalytic dewaxing unit 20, a hydrotreatment unit 30 and a distillation unit 40. A flashed distillate produced via a residue conversion unit is fed into the hydrocracking unit 10B via line 1 and a flashed distillate which is obtained via vacuum distillation of an atmospheric residue is fed into hydrocracking unit 10A via line 5. The effluents from the hydrocrackers 10A and 10B, which may be subjected to a treatment to remove gaseous materials, are introduced via lines 2, 6 and 7 into catalytic dewaxing unit 20. The product from the catalytic dewaxing unit 20 is introduced via line 3 into hydrotreatment unit 30. The effluent from the hydrotreatment unit 30 is subjected via line 4 to distillation in distillation unit 40 to produce various lubricating base oil fractions indicated as 8A, 8B and 8C.

In FIG. 3 a process is depicted comprising a hydrocracking unit 10, a catalytic dewaxing unit 20, a distillation unit 40, a residue conversion unit 50 and two distillation units 60 and 70. A vacuum residue is introduced via line 11, optionally after having been mixed with a recycled distillation residue via lines 17 and 12 as described hereinafter, and line 13 into a residue conversion unit 50. The effluent from the residue conversion unit, which may be subjected to a treatment to remove gaseous materials, is subjected via line 14 to distillation unit 60 to produce a gas oil fraction via line 15, a flashed distillate which is sent to the hydrocracking unit 10 via line 16 and a distillation residue 17 which can be partly recycled to the residue conversion unit via line 12 and which can be used for other purposes via line 18. The flashed distillate produced via residue conversion unit 50 is introduced via line 1, optionally after having been mixed with a recycled distillation residue via lines 25 and 19, into hydrocracking unit 10. The effluent from hydrocracking unit 10, which may be subjected to a treatment to remove gaseous materials, is introduced via line 21 into distillation unit 70 to produce a kerosene fraction via line 22, a gas oil fraction via line 23, a heavy gas oil fraction (suitably boiling between 320°-390° C.) via line 24 and a distillation residue via line 25 which may be partly recycled via line 19 to the hydrocracking unit 10 and which is at least partly sent to catalytic dewaxing unit 20 via line 26. Part of the 320° C.-370° C. fraction may be removed via line 27 and the remainder or all of said fraction is sent to catalytic dewaxing unit 20 via line 28. The feed for the catalytic dewaxing unit 20 is introduced into said unit via lines 26, 28 and 2. The effluent from the catalytic dewaxing unit 20, which may be subjected to a treatment to remove gaseous materials is subjected via line 29 to distillation unit 40 to produce various lubricating base oil fractions indicated as 8A, 8B, 8C and 8D.

In FIG. 4 a process is depicted comprising two hydrocracking units 10C and 10D (which unit is optional in the process as depicted in this Figure), two catalytic dewaxing units 20A and 20B (which unit is optional in the process as depicted in this Figure), two hydrotreatment units 30A and 30B (which unit is optional in the process as depicted in this Figure), a distillation unit 40, a residue conversion unit 50, two further distillation units 60 and 70, an atmospheric distillation unit 80 and a vacuum distillation unit 90. A crude oil is introduced via line 31 to atmospheric distillation unit 80 from which are obtained gaseous material via line 32, a kerosene fraction via line 33, a gas oil fraction via line 34 and an atmospheric residue which is sent via line 35 to vacuum distillation unit 90 from which are obtained a further gas oil fraction, if desired, via line 36, a flashed distillate fraction via line 37 which is subjected to hydrocracking as to be described hereinafter, and a vacuum residue via line 38. The vacuum residue in line 38 is combined with recycled distillation residue via line 39 and sent via line 41 to residue conversion unit 50. If desired a part of the feed to the residue conversion unit (either before or after mixing with recycled material) may be withdrawn from the system via line 42 to serve for other purposes. The effluent from the residue conversion unit 50, which may be subjected to a treatment to remove gaseous materials, is subjected via line 43 to distillation in distillation unit 60 to produce a third gas oil fraction via line 44, a flashed distillate to be subjected to hydrocracking via line 1 and a distillation residue 45 which is partly or totally recycled to residue conversion unit 50. Removal of part of this distillation residue can be achieved via line 46.

When the process as depicted in FIG. 4 is carried out using one hydrocracking unit 10C the combined feed for this hydrocracking unit 10C is collected via line 49 and comprises flashed distillate obtained via the residue conversion unit 50 which is transported via line 1 and which may contain recycled distillation residue via line 52 as described hereinafter, and flashed distillate obtained from vacuum distillation unit 90 which is transported via lines 37 and 48. The effluent from the hydrocracking unit 10C, which may be subjected to a treatment to remove gaseous materials, is sent via line 53A to distillation unit 70.

When the process as depicted in FIG. 4 is carried out using two hydrocracking units 10C and 10D, flashed distillate obtained via the residue conversion unit 50 is sent via line 1, which may contain recycled distillation residue via line 52 as described hereinafter, and line 49 into hydrocracking unit 10C and flashed distillate obtained in the vacuum distillation unit 90 is sent via lines 37 and 51 to hydrocracking unit 10D. If desired, part of the flashed distillate obtained via vacuum distillation unit 90 can be sent to hydrocracking unit 10C via lines 37 and 48. The effluents from the hydrocracking units 10C and 10D, which effluents may be subjected to treatments to remove gaseous materials, are sent via lines 53A and 53B to distillation unit 70.

Via distillation unit 70 a further kerosene fraction is obtained via line 54, a fourth gas oil fraction via line 55, a 320° C.-370° C. fraction via line 56 and a distillation residue fraction via line 57 which may be recycled in part to the hydrocracking unit 10C via line 52 and which is at least partly sent via line 58 to the catalytic dewaxing treatment in catalytic dewaxing unit 20B. When the process as depicted in FIG. 4 is carried out using a single catalytic dewaxing unit 20B, both the 320° C.-370° C. fraction obtained in the distillation unit 70 via line 56 and line 59 and part (or all) of the distillation residue 57 via line 58 are combined to be fed via line 2 to catalytic dewaxing unit 20B. When the process as depicted in FIG. 4 is carried out using two catalytic dewaxing units 20A and 20B, the 320° C.-370° C. fraction obtained via distillation unit 70 is suitably sent to catalytic dewaxing unit 20A via lines 56 and 61 and part (or all) of the distillation residue 57 is sent via lines 58 and 2 to catalytic dewaxing unit 20B.

If desired, part of the 320° C.-370° C. fraction obtained via distillation unit 70 may be sent to catalytic dewaxing unit 20B via lines 57, 59 and 2. It is of course possible to use two distillation units (70A and 70B) when operating in parallel hydrocracking mode (which includes the option to operate with two separated hydrocracking-catalytic dewaxing-hydrotreatment trains) but normally preference will be given to an integrated approach using one distillation unit and one catalytic dewaxing unit.

When the process as depicted in FIG. 4 is carried out using two hydrotreatment units 30A and 30B, the effluent from catalytic dewaxing unit 20B, which may be subjected to a treatment to remove gaseous materials, is sent via lines 62 and 3 to hydrotreatment unit 30A and the effluent from catalytic dewaxing unit 20A, which may be subjected to a treatment to remove gaseous material, is sent via lines 63 and 64 to hydrotreatment unit 30B. If desired, part of the effluent in line 63 may be sent to hydrotreatment unit 30A via lines 65 and 3. When the process as depicted in FIG. 4 is carried out using one hydrotreatment unit 30A, the effluent from catalytic dewaxing unit 20A, which may be subjected to a treatment to remove gaseous materials, is sent to this hydrotreatment unit 30A via lines 62 and 3. When two catalytic dewaxing units are in operation, the effluent from catalytic dewaxing unit 20A, which may be subjected to a treatment to remove gaseous materials, is sent to hydrotreatment unit 30A via lines 63, 65 and 3.

The effluent from the hydrotreatment unit 30A is sent via line 4A to distillation unit 40 and the effluent from hydrotreatment unit 30B (when in operation) is sent via line 4B (which may be combined with line 4A) to distillation unit 40 to produce various lubricating base oil fractions indicated as 8A, 8B, 8C and 8D.

The present invention will now be illustrated by means of the following Example.

EXAMPLE

An experiment was carried out to convert an atmospheric residue of Middle East origin into a lubricating base oil, kerosene and gas oil by subjecting it to a catalytic residue conversion process, a catalytic hydrotreatment and a dewaxing step.

The numbers of the various streams and vessels referred to hereinafter are the same, for ease of reference, as those given in FIG. 3. It should be noted that the distillation unit 60 is made up for the experiment described in this Example as an atmospheric distillation unit and a vacuum distillation unit as will be expressed below.

100 parts by weight (pbw) of an atmospheric residue of Middle East origin was introduced via lines 11 and 13 into catalytic residue conversion unit 50. The catalyst employed was molybdenum on silica and the unit was operated at 435° C. and a hydrogen partial pressure of 150 bar. During the residue conversion stage 3.2 pbw of hydrogen was used in the catalytic residue conversion unit 50. The feedstock was processed at a space velocity of 0.45 kg/kg.h.

The effluent of the catalytic residue conversion unit 50 was sent via line 14 to distillation unit 60 to produce 4.7 pbw of hydrogen sulphide and ammonia, 7.0 pbw of gaseous products boiling below the naphtha-range, 8.3 pbw of naphtha, 18.8 pbw of kerosene, 30.9 pbw of gas oil (obtained via line 15) and 33.7 pbw of bottom fraction which was subjected to vacuum distillation to yield 26.7 pbw of synthetic flashed distillate and 6.0 pbw of vacuum residue (discarded via lines 17 and 18, no recycle). The properties of the synthetic flashed distillate produced by the catalytic residue conversion unit 50 and to be used as feedstock for the catalytic hydrotreatment unit 10 are: density (15/4): 0.89; hydrogen content: 12.2% wt; sulphur content: 0.5% wt; nitrogen content: 0.12% wt; Conradson Carbon Residue: <0.5% wt and mid boiling point of the synthetic flashed distillate: 445° C. The synthetic flashed distillate was sent via line 16 to catalytic hydrotreatment unit 10 containing a catalyst based on nickel/tungsten on alumina. The catalytic hydrotreatment was carried out at a temperature of 405° C., a hydrogen partial pressure of 130 bar and a space velocity of 0.84 kg/kg.h.

The effluent from the catalytic hydrotreatment unit 10 was sent via line 26 to atmospheric distillation unit 70 to produce 0.2 pbw of hydrogen sulphide and ammonia, 1.0 pbw of naphtha-minus, 4.3 pbw of naphtha, 8.3 pbw of kerosene (obtained via line 22), 6.3 pbw of gas oil (obtained via line 23) and 7.2 pbw of distillation residue which was subjected to a dewaxing treatment in dewaxing unit 20, and sent to said unit via lines 26 and 2 (no recycle via line 19 being applied). In dewaxing unit 20 a catalytic hydrodewaxing treatment was carried out using a composite crystalline alumino-silicate dewaxing catalyst containing palladium as noble metal. The catalytic dewaxing was carried out at a temperature of 355° C., a hydrogen partial pressure of 40 bar and at a space velocity of 1.0 kg/kg.l. The feed to be dewaxed contained typically 22% wt of wax. The effluent from the dewaxing unit 20 was sent to distillation unit 40 via line 29 to produce 5.2 pbw of lubricating base oils of the whole viscosity range of distillate derived lubricating base oils in the following composition: 30.8% wt of 80 Neutral, 26.9% wt of 125 Neutral, 23.1% wt of 250 Neutral and 19.2% wt of 500 Neutral.

We claim:

1. A process for the manufacture of lubricating base oils, comprising the steps of: providing a hydrocarbon feedstock containing flashed distillate produced via a residue conversion process; catalytically treating the hydrocarbon feedstock in the presence of hydrogen at a temperature in the range from 250° C. to 500° C. and at a pressure up to 300 bar to obtain treated material; subjecting at least part of a heavy fraction of the treated material obtained to dewaxing, whereby a dewaxed heavy fraction is produced; and recovering at least a lubricating base oil from the dewaxed heavy fraction.

2. The process according to claim 1, wherein the feedstock contains 10 to 60% by volume of the flashed distillate produced via a residue conversion process.

3. The process according to claim 1, wherein the hydrocarbon feedstock is produced via a catalytic residue conversion process.

4. The process according to anyone of claims 1-3, wherein the hydrocarbon feedstock further contains flashed distillate obtained via vacuum distillation of an atmospheric residue.

5. The process according to any one of claim 1-3, wherein the catalytic treatment of the hydrocarbon feedstock comprises a catalytic cracking in the presence of hydrogen.

6. The process according to claim 5, wherein the catalytic cracking is carried out in a signal reactor.

7. The process according to claim 1, wherein the feedstock containing flashed distillate produced via a residue conversion process undergoes the catalytic treatment in parallel with another feedstock containing a flashed distillate obtained via vacuum distillation of an atmospheric residue, including subjecting at least part of the heavy fractions of the treated materials obtained to dewaxing, whereby dewaxed heavy fractions are produced, and recovering at least a lubricating base oil from the dewaxed heavy fractions.

8. The process according to any one of claims 1-3 or 7, wherein at least part of the heavy fraction of the treated material obtained is subjected to catalytic dewaxing.

9. The process according to any one of claims 1-3 or 7, wherein the treated material obtained from the catalytic treatement and having an effective cut point of at least 320° C. is subjected to catalytic dewaxing.

10. The process according to claim 9, wherein part of the treated material having an effective cut point of at least 370° C. is subjected to the catalytic dewaxing and the remainder of the treated material is recyled to the catalytic treatment.

11. The process according to claim 7, wherein the treated material obtained from the parallel catalytic treatment steps are combined and subjected to the catalytic dewaxing.

12. The process according to claim 7, wherein the treated materials obtained from the parallel catalytic treatment steps are separately subjected to the catalytic dewaxing, and at least a lubricating base oil is recovered from the dewaxed heavy fractions produced.

13. The process according to claim 1, wherein at least part of the heavy fraction of the treated material is subjected to a further hydrotreatment, which can be carried out before or after the dewaxing.

14. The process according to claim 13, wherein the further hydrotreatment is carried out with part or all of the heavy fraction of the treated material after the dewaxing.

15. The process according to claim 13, wherein the further hydrotreatment is carried out at a temperature between 250° C. and 375° C. and a pressure between 45 bar and 250 bar to hydrogenate unsaturated components present in the heavy fraction of the treated material.

16. The process according to any one of claims 1-3, 7, 11, 12, 14 or 15, wherein an atmospheric residue is subjected to distillation under reduced pressure to produce a flashed distillate and a vacuum residue, which vacuum residue is to be used as the feedstock for the residue conversion process.

17. The process according to any one of claims 1-3 or 7 wherein kerosene and/or gas oils are co-produced from the resulting hydrotreated material which has not been subjected to catalytic dewaxing.

18. The process according to claim 1, wherein a crude oil is subjected to an atmospheric distillation to produce kerosene and/or gas oil(s) and an atmospheric residue, at least part of the atmospheric residue is subjected to distillation under reduced pressure to produce flashed distillate obtained by distillation under reduced pressure of the atmospheric residue, and a vacuum residue, optionally the flashed distillate obtained by distillation under reduced pressure of the atmospheric residue is subjected to a catalytic treatment in the presence of hydrogen, the vacuum residue is used at least partly as feedstock in the catalytic residue conversion process to produce one or more gas oils and the flashed distillate produced via a residue conversion process, while part or all of a resulting bottom fraction is optionally recycled to the residue conversion process, the flashed distillate produced via a residue conversion process is subjected to the catalytic treatment in the presence of hydrogen, at least part of the treated material is subjected to a distillation treatment to obtain kerosene and one or more gas oils and heavier material, the heavier material obtained is subjected to dewaxing and subsequent hydrotreating, and the lubricating base oil fractions are separated by distillation from the resulting material.

19. The process according to claim 18, wherein the flashed distillate obtained by distillation under reduced pressure of the atmospheric residue and the flashed distillate obtained via a residue conversion process are catalytically cracked in the presence of hydrogen as the catalytic treatment in the presence of hydrogen in a single reactor to produce catalytically cracked material.

20. The process according to claim 19, wherein a heavy distillate fraction obtained after distillation of the catalytically cracked material obtained and part of the bottom fraction obtained after distillation of the catalytically cracked material are subjected to different catalytic dewaxing treatments to produce catalytically dewaxed materials.

21. The process according to claim 20, wherein the catalytic dewaxing treatments are carried out in separate catalytic dewaxing units and wherein the resulting catalytically dewaxed materials are combined and subjected to a further hydrotreating.

22. The process according to claim 2, wherein the feedstock further comprises flashed distillate produced via a catalytic residue conversion process.

23. The process according to claim 4, wherein the catalytic treatment of the hydrocarbon feedstock comprises a catalytic cracking in the presence of hydrogen.

24. The process according to claim 4, wherein at least part of the heavy fraction of the treated material obtained is subjected to catalytic dewaxing.

25. The process according to claim 5, wherein at least part of the heavy fraction of the treated material obtained is subjected to catalytic dewaxing.

26. The process according to claim 4, wherein treated material obtained from the catalytic treatment in the presence of hydrogen, having an effective cut point of at least 320° C. is subjected to catalytic dewaxing.

27. The process according to claim 5, wherein treated material obtained from the catalytic cracking in the presence of hydrogen, having an effective cut point of at least 320° C. is subjected to catalytic dewaxing.

28. The process according to claim 8, wherein treated material obtained from the catalytic treatment in the presence of hydrogen, having an effective cut point of at least 320° C., is subjected to catalytic dewaxing.

29. The process according to claim 4, wherein at least part of the heavy fraction of the treated material obtained is subjected to a further hydrotreatment, which is carried out before or after the dewaxing step.

30. The process according to claim 5, wherein at least part of the heavy fraction of the treated material obtained is subjected to a further hydrotreatment, which is carried out before or after the dewaxing step.

31. The process according to claim 8, wherein at least part of the heavy fraction of treated material obtained is subjected to a further hydrotreatment, which is carried out before or after the dewaxing step.

32. The process according to claim 9, wherein at least part of the heavy fraction of the treated material obtained is subjected to a further hydrotreatment, which is carried out before or after the dewaxing step.

33. The process according to claim 14, wherein the further hydrotreatment is carried out at a temperature between 250° C. and 375° C. and a pressure between 45 bar and 250 bar to hydrogenate unsaturated components present in the dewaxed heavy fraction.

34. The process according to claim 4, wherein an atmospheric residue is subjected to distillation under reduced pressure to produce a flashed distillate and a vacuum residue, which vacuum residue is to be used as the feedstock for the residue conversion process.

35. The process according to claim 5, wherein an atmospheric residue is subjected to distillation under reduced pressure to produce a flashed distillate and a vacuum residue, which vacuum residue is to be used as the feedstock for the residue conversion process.

36. The process according to claim 8, wherein an atmospheric residue is subjected to distillation under reduced pressure to produce a flashed distillate and a vacuum residue, which vacuum residue is to be used as the feedstock for the residue conversion process.

37. The process according to claim 9, wherein an atmospheric residue is subjected to distillation under reduced pressure to produce a flashed distillate and a vacuum residue, which vaccum residue is to be used as the feedstock for the residue conversion process.

38. The process according to claim 13, wherein an atmospheric residue is subjected to distillation under reduced pressure to produce a flashed distillate and a vacuum reduced, which vacuum residue is to be used as the feedstock for the residue conversion process.

* * * * *